US010370901B2

(12) United States Patent
Wiercigroch

(10) Patent No.: US 10,370,901 B2
(45) Date of Patent: Aug. 6, 2019

(54) STEERING SYSTEM

(71) Applicant: ITI Scotland Limited, Glasgow (GB)

(72) Inventor: Marian Wiercigroch, Aberdeen (GB)

(73) Assignee: ITI Scotland Limited, Glasgow (GB)

( * ) Notice: Subject to any disclaimer, the term of this patent is extended or adjusted under 35 U.S.C. 154(b) by 253 days.

(21) Appl. No.: 14/427,205

(22) PCT Filed: Sep. 11, 2013

(86) PCT No.: PCT/EP2013/068846
§ 371 (c)(1),
(2) Date: Mar. 10, 2015

(87) PCT Pub. No.: WO2014/041036
PCT Pub. Date: Mar. 20, 2014

(65) Prior Publication Data

US 2015/0240563 A1 Aug. 27, 2015

(30) Foreign Application Priority Data

Sep. 12, 2012 (GB) ..... 1216286.3

(51) Int. Cl.

| | |
|---|---|
| ***E21B 7/06*** | (2006.01) |
| ***E21B 7/04*** | (2006.01) |
| ***E21B 7/24*** | (2006.01) |
| ***E21B 3/00*** | (2006.01) |

(52) U.S. Cl.
CPC ..... *E21B 7/04* (2013.01); *E21B 3/00* (2013.01); *E21B 7/064* (2013.01); *E21B 7/24* (2013.01)

(58) Field of Classification Search
CPC ..... E21B 7/24; E21B 7/062; E21B 7/064
See application file for complete search history.

(56) References Cited

U.S. PATENT DOCUMENTS 3,291,228 A * 12/1966 Bodine, Jr. ..... E21B 7/24 175/104
3,633,688 A * 1/1972 Bodine ..... E21B 7/24 173/49
4,023,628 A * 5/1977 Bodine ..... E21B 7/24 175/106

(Continued)

FOREIGN PATENT DOCUMENTS

EP 1 923 534 A1 5/2008

OTHER PUBLICATIONS

Kermani, Nathalie, International Search Report and Written Opinion, European Patent Office, PCT/EP2013/068846, dated Sep. 8, 2014.

(Continued)

*Primary Examiner* — Giovanna C Wright
(74) *Attorney, Agent, or Firm* — Gavrilovich, Dodd & Lindsey LLP

(57) ABSTRACT

Provided is an apparatus for use in directional drilling, which apparatus comprises:

(a) a drill bit;
(b) at least one steering actuator capable of exerting a longitudinal force on the drill bit, so as to change the direction of drilling; and/or
(c) at least one drill bit steering insert, capable of extending and retracting so as to change the cutting characteristics of the drill bit and thereby change the direction of drilling.

Further provided is a method of directional drilling, employing the apparatus of the invention.

17 Claims, 7 Drawing Sheets

(56) References Cited

U.S. PATENT DOCUMENTS

| | | | | |
|---|---|---|---|---|
| 6,142,250 | A * | 11/2000 | Griffin | E21B 7/068 175/381 |
| 7,392,857 | B1 * | 7/2008 | Hall | E21B 4/14 175/297 |
| 2007/0114068 | A1 | 5/2007 | Hall et al. | |
| 2007/0221408 | A1 | 9/2007 | Hall et al. | |
| 2009/0065262 | A1 | 3/2009 | Downton et al. | |
| 2009/0272579 | A1 * | 11/2009 | Sihler | E21B 7/064 175/45 |
| 2010/0319994 | A1 | 12/2010 | Wiercigroch | |
| 2011/0220417 | A1 * | 9/2011 | Pafitis | E21B 7/064 175/61 |
| 2012/0018225 | A1 | 1/2012 | Peter et al. | |
| 2012/0043133 | A1 | 2/2012 | Nukket | |
| 2012/0318580 | A1 * | 12/2012 | Oesterberg | E21B 7/064 175/57 |
| 2014/0054090 | A1 * | 2/2014 | Schicker | E21B 4/10 175/95 |

OTHER PUBLICATIONS

Ellis Lyndon, International Search Report, British Patent Office, GB1216286.3, dated Nov. 7, 2012.

* cited by examiner

STEERING SYSTEM

CROSS REFERENCE TO RELATED APPLICATIONS

This application is a U.S. National Stage Application filed under 35 U.S.C. § 371 and claims priority to International Application No. PCT/EP2013/068846, filed Sep. 11, 2013, which application claims priority to Great Britain Application No. 1216286.3, filed Sep. 12, 2012, the disclosure of which are incorporated herein by reference.

FIELD OF THE INVENTION

The present application concerns a steering system and a method of steering for use in directional drilling, and in particular resonance enhanced directional drilling (REDD). The system and method are advantageous in enabling improved steering of a drilling module, in particular remote steering. The system allows for improved steering control and accuracy in 3-dimensional space (or 2-dimensional).

BACKGROUND

In drilling, and in particular deep drilling (such as that required in the mining and oil industries), it is not usually possible, or sometimes desirable, to drill down to the required area in a straight line. This may be due to the nature of the material through which drilling is taking place (e.g. a particularly hard or unstable section of rock), or due to the probable location of the target area that the drilling is attempting to reach. It is therefore desirable to be able to control the direction of drilling of the drill bit, in order to steer the drill string and drill assembly toward a target zone within the material (usually a rock formation) being drilled.

It is known to re-direct the drill bit by installing specially designed equipment, which cannot be used for vertical drilling. One method uses a bent housing tool to allow the drill bit to initiate a progression face at a required angle (Kravits, et al., "Directional Drilling Techniques for Exploration In-advance of Mining", World Mining Equipment, 1994). The disadvantage of these techniques is that they are time consuming, requiring the fitting and then un-fitting of the special tools whenever a change in direction is required. Moreover, the direction change is limited, based upon the geometries of the available tools, and fine control is not possible.

Other techniques have been developed to try and solve these problems. A more elaborate solution involves employing a steerable "mud motor" which may be installed in the drill assembly and controlled remotely from the surface ("How Does Directional Drilling Work?", rigzone.com, [http://www.]rigzone.com/training/insight.asp?insight_id=295&c_id=1, accessed 14 May 2012). Typically, a mud motor is capable of channeling fluid preferentially to one side of the drill assembly, creating a force perpendicular to the axis of drilling, which "pushes" the drill assembly in the desired direction. This has the advantage that it does not involve fitting and un-fitting of tools, and also allows more fine control. However, there is still a need to increase the accuracy of the control, and there is a further disadvantage that the drill assembly is made highly complex by the addition of further machinery, which adds to its mass, and, as with any additional complexity, can be the cause of costly malfunction.

SUMMARY

It is an aim of the present invention to solve the above problems identified in prior art directional drilling systems and methods. In particular, it is an aim of the present invention to provide an improved steering system for use in directional drilling, and resonance enhanced directional drilling, which systems and methods provide greater steering accuracy and control than known methods and systems, whilst improving reliability and reducing cost by avoiding heavy and complex equipment.

Accordingly, the present invention provides an apparatus for use in directional drilling, which apparatus comprises:

(a) a drill bit;

(b) at least one steering actuator capable of exerting a longitudinal force on the apparatus, so as to change the direction of drilling; and/or (c) at least one drill bit steering insert, capable of extending and retracting so as to change the cutting characteristics of the drill bit and thereby change the direction of drilling.

In the context of the present invention, 'directional drilling' means any type of drilling in which the direction of drilling can be changed such that the resulting bore hole (specifically the axis of the bore hole) is not a straight line. This includes any and all types of directional drilling currently known in the art.

Also in the context of the present invention, 'longitudinal' means: in a direction substantially parallel to the axis of the apparatus itself; and/or substantially parallel to the axis of rotation of the apparatus, the drill assembly, or the drill bit; and/or substantially parallel to the axis of the bore hole in the region where the steering actuator is located.

In operation, one or more steering actuators are turned on, so that the longitudinal force is exerted on one side of the apparatus preferentially. This in turn will expand (or contract) the apparatus preferentially on one side, thus 'bending' the apparatus sufficiently to turn the drill bit through a small angle. This deformation will continue until the steering actuator(s) are turned off. In the 'bent' configuration, the apparatus will drill through a curved trajectory, determined by the degree of bend created by the actuator(s). Thus, the curvature of the trajectory can be controlled by exerting greater or lesser force through the actuator(s) (i.e. creating greater or lesser 'bend' in the apparatus) and the direction may be controlled by selecting one or more actuators on one side of the apparatus so that the force acts asymmetrically to create the required 'bend' in a chosen direction.

Alternatively (or in addition) one or more drill bit steering inserts are operated so that they are extended from the face of the drill bit for a portion of the drill bit rotation, and retracted during the remaining part of the rotation. Thus, the extension occurs only within a chosen angle of rotation of the drill bit, such that the insert will contact only a chosen portion of the rock face that is in contact with the drill bit. In this way, the rock face is drilled preferentially at the chosen point of contact with the insert. The drill assembly and bore hole then turns in the direction of the preferential drilling.

The advantage of both of these systems is that they allow a steering in any direction without fitting special tools and without complicated mud motors. Moreover, they both allow much finer control, and can bit switched off as easily and quickly as they are switched on, allowing straight drilling to resume. Access to a full 3-dimensional space downhole becomes possible, in a cost effective and efficient manner. Electronic feedback mechanisms and computer control technology can assist the apparatus in achieving the high degree of precision control that is possible using this system.

The present invention further provides a method of drilling comprising operating an apparatus as defined above. Typically, the present method comprises operating one or more of the steering actuators to thereby cause a desired change in direction of drilling, and/or operating one or more of the steering inserts to thereby cause a desired change in direction of drilling.

The present invention will now be described in more detail, by way of example only, with reference to the accompanying Figures.

DETAILED DESCRIPTION

Figure 1:
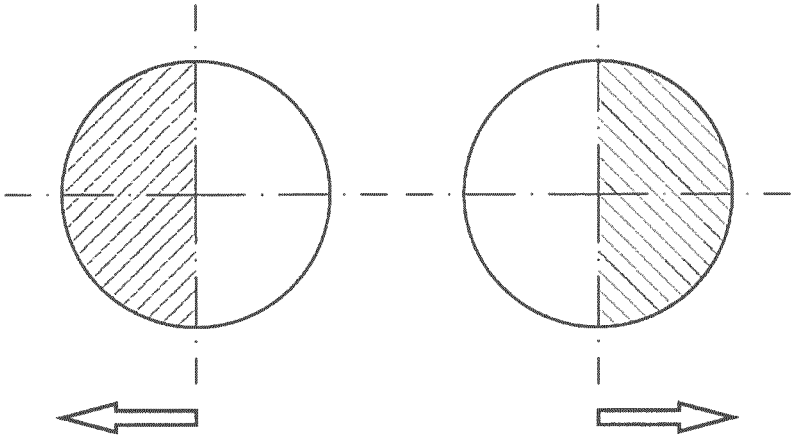
FIG. 1 shows activation zones for steering in different directions. The longitudinal force from the steering actuators, or the preferential drilling from the steering inserts, will cause one side of the drilling zone to be preferentially drilled.
Figure 2:
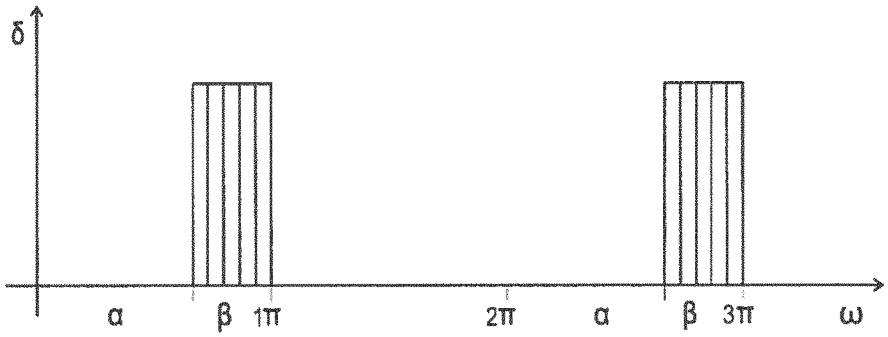
FIG. 2 shows an electronic activation impulse that may be sent to a steering insert in order to control extension of the insert at a required angle of rotation.
Figure 3:
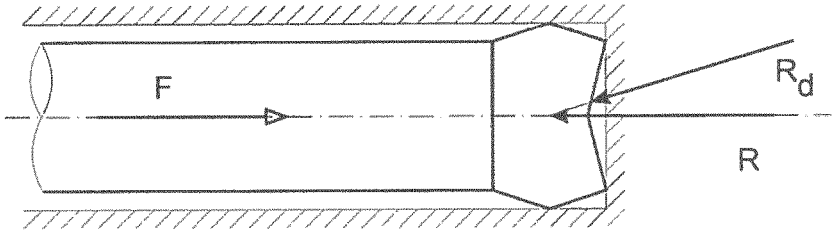
FIG. 3 shows forces on the drill-bit (F—weight-on-bit force, R—reaction force, Rd—effective reaction force after the application of the RED impulse control).
Figure 4:
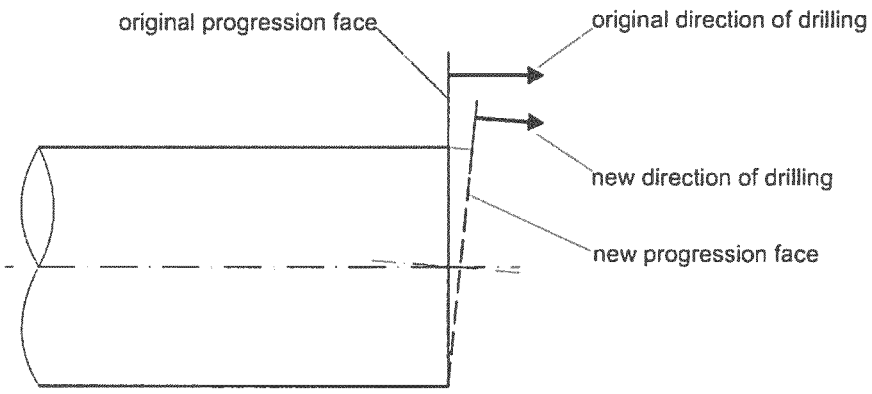
FIG. 4 shows the change of drilling direction after applying the activation impulse.
Figure 5:
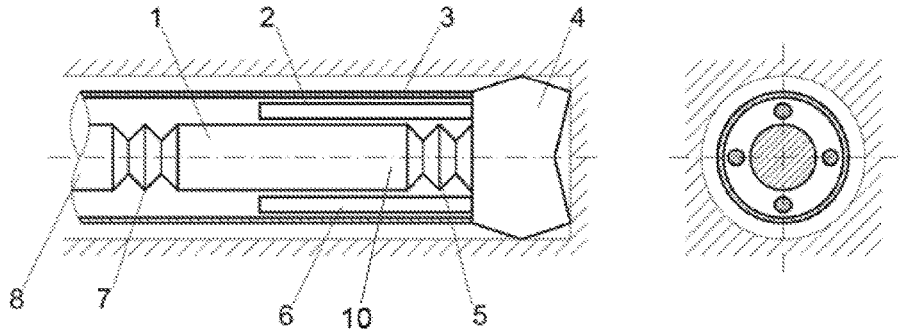
FIG. 5 shows a conceptual representation of an apparatus of the invention with one main (RED) actuator and four additional steering actuators (1—main actuator, 2—additional steering actuator, 3—external casing of the apparatus, 4—drill-bit, 5—RED vibration enhancer spring, 6—additional steering actuator, 7—RED vibration isolator spring, 8—connection with the drill-string, 10—oscillator) with a cross-section.
Figure 6:
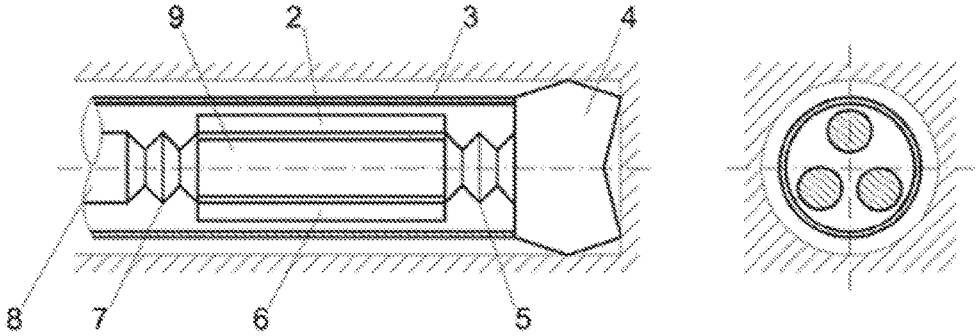
FIG. 6 shows a conceptual representation of an apparatus of the invention with three equivalent actuators acting as steering actuators and also as RED actuators instead of a main actuator (2—actuator, 3—external casing of the apparatus, 4—drill-bit, 5—RED vibration enhancer spring, 6—actuator, 7—RED vibration isolator spring, 8—connection with the drill-string, 9—oscilator) with a cross-section.
Figure 7:
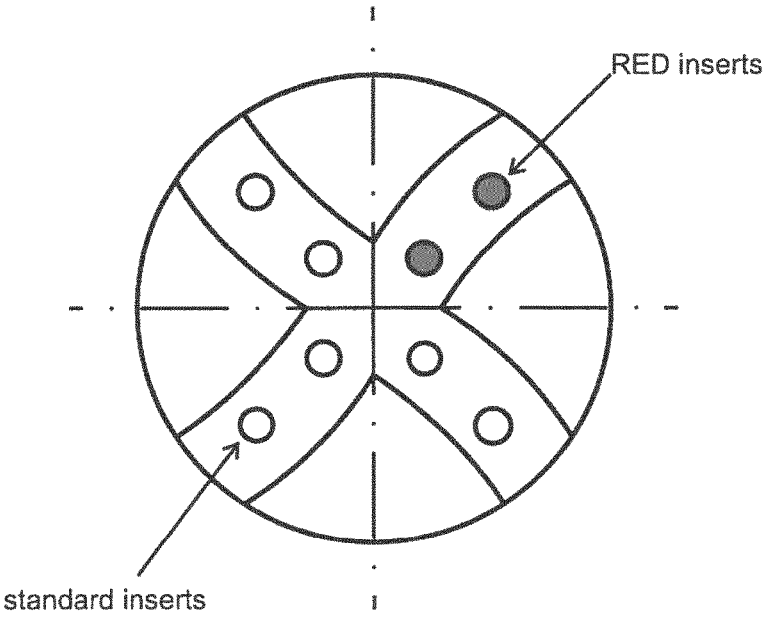
FIG. 7 shows a simplified representation of the bottom of the drill-bit with a combination of steering inserts (termed RED inserts in the Figure) and standard inserts.

A detailed description of the invention will now be provided.

The steering actuator and the drill bit steering insert are not especially limited, and may comprise any element capable of providing the functionality described. In typical embodiments, the steering actuator comprises a piezoelectric element (or other similar element capable of generating controllable dynamic force) to drive the steering actuator, and/or the drill bit steering insert comprises a piezoelectric element (or other similar element capable of generating controllable dynamic force) to drive the extending and retracting of the steering insert. Such piezoelectric elements are particularly advantageous, since they may be integrated easily with electronic and computer controlled systems.

It is possible for the system to operate satisfactorily with a single steering actuator, if (for example) steering in a single direction were required, or alternatively by allowing the actuator to be rotated about the axis of drilling in order to select the steering direction. However, typically the apparatus comprises a plurality of steering actuators arranged about the axis of rotation of the drill bit. Thus, the apparatus may comprise 1 or more, 2 or more, 3 or more, 4 or more, 5 or more, 6 or more, 7 or more, 8 or more, 9 or more, or 10 or more steering actuators. Strictly, an arrangement that is symmetric about the axis is not required, however operation of the device is simplified using a symmetric arrangement.

When the drill bit steering inserts are employed, the apparatus may comprise one or more steering inserts arranged symmetrically or asymmetrically about the axis of rotation of the drill bit. The inserts are typically not located on the rotational axis of the drill bit, since normally this would not cause a change in direction of drilling, but would rather only increase the drilling speed. However, in more complex rock formations, it is possible to envisage differential properties in the rock formation on either side of the apparatus, which might require steering using this technique. It is therefore not ruled out entirely. In typical embodiments the one or more steering inserts are located along one or more radii of the drill bit. Where there are 2 or more inserts it is typical that the inserts are arranged in a line along the same radius of the drill bit. It may also be the case that the one or more steering inserts are arranged asymmetrically about the axis of rotation of the drill bit, and symmetry is established by the presence of non-steering inserts (regular inserts) at other locations within the drill bit. However, a symmetrical arrangement of steering inserts may also be used. The number of steering inserts is not especially limited, and may be selected by the skilled person depending upon the type of drilling employed. Where tighter turning is required, a larger number of inserts may be present. Thus, the apparatus may comprise 1 or more, 2 or more, 3 or more, 4 or more, 5 or more, 6 or more, 7 or more, 8 or more, 9 or more, or 10 or more steering inserts.

As has been alluded to above, the apparatus is particularly advantageous for use in resonance enhanced directional drilling (REDD). Resonance enhanced drilling (RED) is a special type of percussion enhanced rotary drilling in which an oscillator (the RED oscillator—driven by an actuator, such as a main actuator (RED actuator) or the steering actuators mentioned in the present invention) is vibrated at high frequency so as to achieve resonance with the material being drilled. This results in an amplification of the pressure exerted at the drill-bit thus increasing drilling efficiency when compared to standard percussion enhanced rotary drilling. The present inventors have previously disclosed (in WO 2007/141550 and WO 2007/141550) a resonance enhanced rotary drill comprising an automated feedback and control mechanism which can continuously adjust the frequency and stroke of percussion forces to maintain resonance as a drill passes through rocks of differing type. The drill is provided with an adjustment means which is responsive to conditions of the material through which the drill is passing and a control means in a downhole location which includes sensors for taking downhole measurements of material characteristics whereby the apparatus is operable downhole under closed loop real-time control. The present invention is especially suitable for use in this type of RED.

When used in RED, the present apparatus typically further comprises a RED actuator located on the axis of rotation of the drill bit for driving an oscillator, the oscillator thereby being capable of generating an axial oscillatory load with a varying frequency. Typically but not exclusively, the RED actuator comprises a piezoelectric element for driving the oscillator. In an alternative arrangement, the apparatus may comprise a plurality of steering actuators arranged symmetrically about the axis of rotation of the drill bit, which are capable of driving the RED oscillator (as well as acting as steering actuators), and thus the apparatus does not need to comprise a main actuator located on the axis of rotation of the drill bit. In this arrangement the plurality of steering actuators are capable of acting to drive the oscillator, the oscillator thereby being capable of generating an axial oscillatory load with a varying frequency.

When the apparatus comprises an oscillator for applying an axial oscillatory loading under RED, it may further comprises one or both of:

(a) a vibration damping and/or isolation unit; and (b) a vibration enhancement and/or transmission unit.

These units are useful in transmitting sufficient oscillatory load to improve resonance enhanced drilling performance, whilst at the same time protecting the drill string above the drill assembly from the oscillation.

Typically, the vibration damping and/or isolation unit and/or the vibration enhancement and/or transmission unit comprise a spring system comprising two or more frusto-conical springs arranged in series. The spring system is advantageously one such that the force, P, applied to the spring system can be determined according to the following equation:

$$P = \frac{1.1E\delta C}{R^2}\left[(h-\delta)\left(h-\frac{\delta}{2}\right)t + t^2\right]$$

wherein t is the thickness of the frusto-conical springs, h is the height of the spring system, R is the radius of the spring system, δ is the displacement on the spring system caused by the force P, E is the Young modulus of the spring system, and C is the constant of the spring system.

The spring system may comprise one or more Belleville springs.

Advantageously, the spring system of the vibration damping and/or isolation unit satisfies the following equation:

$$\omega/\omega_n \geq 2.3$$

wherein ω represents an operational frequency of axial vibration of the resonance enhanced drilling apparatus, and $\omega_n$ represents the natural frequency of the spring system of the vibration damping and/or isolation unit.

Furthermore, typically the spring system of the vibration enhancement and/or transmission unit satisfies the following equation:

$$0.6 \leq \omega/\omega_n \leq 1.2$$

wherein ω represents an operational frequency of axial vibration of the resonance enhanced drilling apparatus, and $\omega_n$ represents the natural frequency of the spring system of the vibration enhancement and/or transmission unit.

The vibration damping and/or isolation unit is typically situated above the RED oscillator in the drilling apparatus. The vibration enhancement and/or transmission unit is typically situated below the RED oscillator in the drilling apparatus.

When an oscillator is present in the apparatus for applying a RED axial oscillatory loading, the frequency (f) and the dynamic force ($F_d$) of the oscillator are typically capable of being controlled by a controller. In such cases, the frequency (f) and the dynamic force ($F_d$) of the oscillator are typically capable of control according to load cell measurements representing changes in the compressive strength ($U_s$) of material being drilled. This will be explained in more detail below, where the principles of RED that may be utilised with the invention are set out in more depth.

The present apparatus may form part of a drilling module. Typically the drilling module will perform the drilling at the rock face, and is connected to the surface through the bore hole by the drill string. As has been mentioned, it is envisaged that the present apparatus (drilling module) will be employed as a resonance enhanced drilling module in a drill-string. The drill-string configuration is not especially limited, and any configuration may be envisaged, including known configurations. The module may be turned on or off as and when resonance enhancement is required, and the steering mechanism may be turned on or off as and when steering is required.

As has been mentioned above, the RED oscillator is typically driven by a main piezoelectric actuator, or by the steering actuators. However, in some RED arrangements, the RED oscillator may comprise an electrically driven mechanical actuator.

The preferred applications for the apparatus are in large scale drilling apparatus, control equipment and methods of drilling for the oil and gas industry. However, other drilling applications may also benefit from steering, including: surface drilling equipment, control equipment and methods of drilling for road contractors; drilling equipment, control equipment and method of drilling for the mining industry; hand held drilling equipment for home use and the like; specialist drilling, e.g. dentist drills.

During resonance enhanced drilling module operation, the drill-bit is rotated relative to the sample, and an axially oriented dynamic loading is applied to the drill-bit by the RED oscillator to generate a crack propagation zone to aid the drill-bit in cutting though material.

The RED oscillator and/or dynamic exciter is controlled in accordance with preferred methods of the present invention. Thus, the invention further provides a method for resonance enhanced directional drilling comprising an apparatus as defined above, the method comprising:

controlling frequency (f) of the oscillator in the resonance enhanced drill whereby the frequency (f) is maintained in the range:

$$(D^2U_s/(8000\pi Am))^{1/2} \leq f \leq S_f(D^2U_s/(8000\pi Am))^{1/2}$$

where D is diameter of the drill-bit, $U_s$ is compressive strength of material being drilled, A is amplitude of vibration, m is vibrating mass, and $S_f$ is a scaling factor greater than 1; and controlling dynamic force ($F_d$) of the oscillator in the resonance enhanced rotary drill whereby the dynamic force ($F_d$) is maintained in the range:

$$[(\pi/4)D^2_{eff}U_s] \leq F_d \leq S_{Fd}[(\pi/4)D^2_{eff}U_s]$$

where $D_{eff}$ is an effective diameter of the drill-bit, $U_s$ is a compressive strength of material being drilled, and $S_{Fd}$ is a scaling factor greater than 1, wherein the frequency (f) and the dynamic force ($F_d$) of the oscillator are controlled by monitoring signals representing the compressive strength ($U_s$) of the material being drilled and adjusting the frequency (f) and the dynamic force ($F_d$) of the oscillator using a closed loop real-time feedback mechanism according to changes in the compressive strength ($U_s$) of the material being drilled. Optionally this method further comprises a step of operating one or more steering actuators and/or one or more steering inserts to cause the drilling module to turn in a desired direction.

The ranges for the frequency and dynamic force are based on the following analysis.

The compressive strength of the formation gives a lower bound on the necessary impact forces. The minimum required amplitude of the dynamic force has been calculated as:

$$F_d = \frac{\pi}{4} D_{eff}^2 U_s.$$

$D_{eff}$ is an effective diameter of the drill-bit which is the diameter D of the drill-bit scaled according to the fraction of the drill-bit which contacts the material being drilled. Thus, the effective diameter $D_{eff}$ may be defined as:

$$D_{eff} = \sqrt{S_{contact}} D,$$

where $S_{contact}$ is a scaling factor corresponding to the fraction of the drill-bit which contacts the material being drilled. For example, estimating that only 5% of the drill-bit surface is in contact with the material being drilled, an effective diameter $D_{eff}$ can be defined as:

$$D_{eff} = \sqrt{0.05} D.$$

The aforementioned calculations provide a lower bound for the dynamic force of the oscillator. Utilizing a dynamic force greater than this lower bound generates a crack propagation zone in front of the drill-bit during operation. However, if the dynamic force is too large then the crack propagation zone will extend far from the drill-bit compromising borehole stability and reducing borehole quality. In addition, if the dynamic force imparted on the rotary drill by the oscillator is too large then accelerated and catastrophic tool wear and/or failure may result. Accordingly, an upper bound to the dynamic force may be defined as:

$$S_{Fd}[(\pi/4) D^2_{eff} U_s]$$

where $S_{Fd}$ is a scaling factor greater than 1. In practice $S_{Fd}$ is selected according to the material being drilled so as to ensure that the crack propagation zone does not extend too far from the drill-bit compromising borehole stability and reducing borehole quality. Furthermore, $S_{Fd}$ is selected according to the robustness of the components of the rotary drill to withstand the impact forces of the oscillator. For certain applications $S_{Fd}$ will be selected to be less than 5, preferably less than 2, more preferably less than 1.5, and most preferably less than 1.2. Low values of $S_{Fd}$ (e.g. close to 1) will provide a very tight and controlled crack propagation zone and also increase lifetime of the drilling components at the expensive of rate of propagation. As such, low values for $S_{Fd}$ are desirable when a very stable, high quality borehole is required. On the other hand, if rate of propagation is the more important consideration then a higher value for $S_{Fd}$ may be selected.

During impacts of the oscillator of period $\tau$, the velocity of the drill-bit of mass m changes by an amount $\Delta v$, due to the contact force F=F(t):

$$m\Delta V = \int_0^{\tau} F(t)dt,$$

where the contact force F(t) is assumed to be harmonic. The amplitude of force F(t) is advantageously higher than the force $F_d$ needed to break the material being drilled. Hence a lower bound to the change of impulse may be found as follows:

$$m\Delta V = \int_0^{\tau} F_d \sin\left(\frac{\pi t}{\tau}\right) dt = \frac{1}{2} U_s\, 0.05\, D^2 \tau.$$

Assuming that the drill-bit performs a harmonic motion between impacts, the maximum velocity of the drill-bit is $v_m = A\omega$, where A is the amplitude of the vibration, and $\omega = 2\pi f$ is its angular frequency. Assuming that the impact occurs when the drill-bit has maximum velocity $v_m$, and that the drill-bit stops during the impact, then $\Delta v = v_m = 2A\pi f$. Accordingly, the vibrating mass is expressed as $$m = \frac{0.05 D^2 U_s \tau}{4\pi f A}.$$

This expression contains $\tau$, the period of the impact. The duration of the impact is determined by many factors, including the material properties of the formation and the tool, the frequency of impacts, and other parameters. For simplicity, $\tau$ is estimated to be 1% of the time period of the vibration, that is, $\tau = 0.01/f$. This leads to a lower estimation of the frequency that can provide enough impulse for the impacts:

$$f = \sqrt{\frac{D^2 U_s}{8000\, \pi A m}}.$$

The necessary minimum frequency is proportional to the inverse square root of the vibration amplitude and the mass of the bit.

The aforementioned calculations provide a lower bound for the frequency of the oscillator. As with the dynamic force parameter, utilizing a frequency greater than this lower bound generates a crack propagation zone in front of the drill-bit during operation. However, if the frequency is too large then the crack propagation zone will extend far from the drill-bit compromising borehole stability and reducing borehole quality. In addition, if the frequency is too large then accelerated and catastrophic tool wear and/or failure may result. Accordingly, an upper bound to the frequency may be defined as:

$$S_f(D^2 U_s/(8000\pi A M))^{1/2}$$

where $S_f$ is a scaling factor greater than 1. Similar considerations to those discussed above in relation to $S_{Fd}$ apply to the selection of $S_f$. Thus, for certain applications $S_f$ will be selected to be less than 5, preferably less than 2, more preferably less than 1.5, and most preferably less than 1.2.

In addition to the aforementioned considerations for operational frequency of the oscillator, it is advantageous that the frequency is maintained in a range which approaches, but does not exceed, peak resonance conditions for the material being drilled. That is, the frequency is advantageously high enough to be approaching peak resonance for the drill-bit in contact with the material being drilled while being low enough to ensure that the frequency does not exceed that of the peak resonance conditions which would lead to a dramatic drop off in amplitude. Accordingly, $S_f$ is advantageously selected whereby:

$$f_r/S_f \leq f \leq f_r$$

where $f_r$ is a frequency corresponding to peak resonance conditions for the material being drilled and $S_r$ is a scaling factor greater than 1.

Similar considerations to those discussed above in relation to $S_{Fd}$ and $S_f$ apply to the selection of $S_r$. For certain applications $S_r$ will be selected to be less than 2, preferably less than 1.5, more preferably less than 1.2. High values of $S_r$ allow lower frequencies to be utilized which can result in a smaller crack propagation zone and a lower rate of propagation. Lower values of $S_r$ (i.e. close to 1) will constrain the frequency to a range close to the peak resonance conditions which can result in a larger crack propagation zone and a higher rate of propagation. However, if the crack propagation zone becomes too large then this may compromise borehole stability and reduce borehole quality.

One problem with drilling through materials having varied resonance characteristics is that a change in the resonance characteristics could result in the operational frequency suddenly exceeding the peak resonance conditions which would lead to a dramatic drop off in amplitude. To solve this problem it may be appropriate to select $S_f$ whereby:

$$f \leq (f_r - X)$$

where X is a safety factor ensuring that the frequency (f) does not exceed that of peak resonance conditions at a transition between two different materials being drilled. In such an arrangement, the frequency may be controlled so as to be maintained within a range defined by:

$$f_r/S_r \leq f \leq (f_r - X)$$

where the safety factor X ensures that the frequency is far enough from peak resonance conditions to avoid the operational frequency suddenly exceeding that of the peak resonance conditions on a transition from one material type to another which would lead to a dramatic drop off in amplitude.

Similarly a safety factor may be introduced for the dynamic force. For example, if a large dynamic force is being applied for a material having a large compressive strength and then a transition occurs to a material having a much lower compressive strength, this may lead to the dynamic force suddenly being much too large resulting in the crack propagation zone extend far from the drill-bit compromising borehole stability and reducing borehole quality at material transitions. To solve this problem it may be appropriate to operate within the following dynamic force range:

$$F_d \leq S_{Fd}[(\pi/4)D^2_{eff}U_s - Y]$$

where Y is a safety factor ensuring that the dynamic force ($F_d$) does not exceed a limit causing catastrophic extension of cracks at a transition between two different materials being drilled. The safety factor Y ensures that the dynamic force is not too high that if a sudden transition occurs to a material which has a low compressive strength then this will not lead to catastrophic extension of the crack propagation zone compromising borehole stability.

The safety factors X and/or Y may be set according to predicted variations in material type and the speed with which the frequency and dynamic force can be changed when a change in material type is detected. That is, one or both of X and Y are preferably adjustable according to predicted variations in the compressive strength ($U_s$) of the material being drilled and speed with which the frequency (f) and dynamic force ($F_d$) can be changed when a change in the compressive strength ($U_s$) of the material being drilled is detected. Typical ranges for X include: $X > f_r/100$; $X > f_r/50$; or $X > f_r/10$. Typical ranges for Y include: $Y > S_{Fd}\ [(\pi/4)D^2_{eff}U_s]/100$; $Y > S_{Fd}\ [(\pi/4)D^2_{eff}U_s]/50$; or $Y > S_{Fd}\ [(\pi/4)D^2_{eff}U_s]/10$.

Embodiments which utilize these safety factors may be seen as a compromise between working at optimal operational conditions for each material of a composite strata structure and providing a smooth transition at interfaces between each layer of material to maintain borehole stability at interfaces.

The previously described embodiments of the present invention are applicable to any size of drill or material to be drilled. Certain more specific embodiments are directed at drilling modules for drilling through rock formations, particularly those of variable composition, which may be encountered in deep-hole drilling applications in the oil, gas and mining industries. The question remains as to what numerical values are suitable for drilling through such rock formations.

The compressive strength of rock formations has a large variation, from around $U_s$=70 MPa for sandstone up to $U_s$230 MPa for granite. In large scale drilling applications such as in the oil industry, drill-bit diameters range from 90 to 800 mm (3½ to 32"). If only approximately 5% of the drill-bit surface is in contact with the rock formation then the lowest value for required dynamic force is calculated to be approximately 20 kN (using a 90 mm drill-bit through sandstone). Similarly, the largest value for required dynamic force is calculated to be approximately 6000 kN (using an 800 mm drill-bit through granite). As such, for drilling through rock formations the dynamic force is preferably controlled to be maintained within the range 20 to 6000 kN depending on the diameter of the drill-bit. As a large amount of power will be consumed to drive an oscillator with a dynamic force of 6000 kN it may be advantageous to utilize the invention with a mid-to-small diameter drill-bit for many applications. For example, drill-bit diameters of 90 to 400 mm result in an operational range of 20 to 1500 kN. Further narrowing the drill-bit diameter range gives preferred ranges for the dynamic force of 20 to 1000 kN, more preferably 20 to 500 kN, more preferably still 20 to 300 kN.

A lower estimate for the necessary displacement amplitude of vibration is to have a markedly larger vibration than displacements from random small scale tip bounces due to inhomogeneities in the rock formation. As such the amplitude of vibration is advantageously at least 1 mm. Accordingly, the amplitude of vibration of the oscillator may be maintained within the range 1 to 10 mm, more preferably 1 to 5 mm.

For large scale drilling equipment the vibrating mass may be of the order of 10 to 1000 kg. The feasible frequency range for such large scale drilling equipment does not stretch higher than a few hundred Hertz. As such, by selecting suitable values for the drill-bit diameter, vibrating mass and amplitude of vibration within the previously described limits, the frequency (f) of the oscillator can be controlled to be maintained in the range 100 to 500 Hz while providing sufficient dynamic force to create a crack propagation zone for a range of different rock types and being sufficiently high frequency to achieve a resonance effect.

A controller may be configured to perform the previously described method and incorporated into a resonance enhanced directional drilling module such as those described in the various embodiments of the invention above. The resonance enhanced directional drilling module may be provided with sensors (the load cells) which monitor the compressive strength of the material being drilled, either directly or indirectly, and provide signals to the controller which are representative of the compressive strength of the material being drilled. The controller is configured to receive the signals from the sensors and adjust the frequency (f) and the dynamic force ($F_d$) of the oscillator using a closed loop real-time feedback mechanism according to changes in the compressive strength ($U_s$) of the material being drilled.

The inventors have determined that, the best arrangement for providing feedback control is to locate all the sensing, processing and control elements of the feedback mechanism within a down hole assembly. This arrangement is the most compact, provides faster feedback and a speedier response to changes in resonance conditions, and also allows drill heads to be manufactured with the necessary feedback control integrated therein such that the drill heads can be retro fitted to existing drill strings without requiring the whole of the drilling system to be replaced.

The invention claimed is:

1. An apparatus for use in resonance enhanced directional drilling, which apparatus comprises:

(a) a rotary drill bit;

(b) an oscillator;

(c) a plurality of steering actuators arranged about the axis of rotation of the drill bit, wherein said plurality of steering actuators are capable of driving the oscillator to generate an axial oscillatory load with a varying frequency so as to achieve resonance with a material being drilled and wherein each of the plurality of steering actuators is capable of exerting the axial load on a side of the apparatus; and (d) a resonance enhanced drilling (RED) vibration isolator spring.

2. An apparatus according to claim 1, wherein the steering actuator comprises a piezoelectric element to drive the steering actuators.

3. An apparatus according to claim 1, which apparatus comprises 3, 4, 5, 6, 7, 8, 9, or 10 or more steering actuators.

4. An apparatus according to claim 1, which apparatus does not comprise a main actuator located on the axis of rotation of the rotary drill bit.

5. An apparatus according to claim 1, which apparatus further comprises a RED vibration enhancer spring.

6. An apparatus according to claim 5, wherein the RED vibration isolator spring and the RED vibration enhancer spring comprise a spring system comprising two or more frusto-conical springs arranged in series.

7. An apparatus according to claim 6, wherein the spring system is one such that the force, P, applied to the spring system can be determined according to the following equation:

$$P = \frac{1.1\,E\delta C}{R^2}\left[(h-\delta)\left(h-\frac{\delta}{2}\right)t + t^2\right]$$

wherein t is the thickness of the frusto-conical springs, h is the height of the spring system, R is the radius of the spring system, δ is the displacement on the spring system caused by the force P, E is the Young modulus of the spring system, and C is the constant of the spring system.

8. An apparatus according to claim 6, wherein the frusto-conical springs are Belleville springs.

9. An apparatus according to claim 6, wherein the spring system satisfies the following equation:

$$\omega/\omega_n \geq 2.3$$

wherein ω represents an operational frequency of axial vibration of the resonance enhanced drilling apparatus, and $\omega_n$ represents the natural frequency of the spring system.

10. An apparatus according to claim 6, wherein the spring system satisfies the following equation:

$$0.6 \leq \omega/\omega_n \leq 1.2$$

wherein ω represents an operational frequency of axial vibration of the resonance enhanced drilling apparatus, and $\omega_n$ represents the natural frequency of the spring system of the vibration enhancement and/or transmission unit.

11. An apparatus according to claim 5, wherein the RED vibration isolator spring is situated above the oscillator in the drilling apparatus.

12. An apparatus according to claim 5, wherein the RED vibration enhancer spring is situated below the oscillator in the drilling apparatus.

13. An apparatus according to claim 1, wherein the frequency (f) and the dynamic force ($F_d$) of the oscillator are capable of being controlled by a controller.

14. An apparatus according to claim 13, wherein the frequency (f) and the dynamic force ($F_d$) of the oscillator are capable of control according to load cell measurements representing changes in the compressive strength ($U_s$) of material being drilled.

15. A method of drilling comprising operating an apparatus as defined in claim 1.

16. A method of drilling according to claim 15, which method comprises operating one or more of the steering actuators and thereby cause a desired change in direction of drilling.

17. A method for resonance enhanced directional drilling using an apparatus as defined in claim 1, the method comprising:

controlling frequency (f) of the oscillator in the resonance enhanced drill whereby the frequency (f) is maintained in the range:

$$(D^2U_s/(8000\pi Am))^{1/2} \leq f \leq S_f(D^2U_s/(8000\pi Am))^{1/2}$$

where D is diameter of the drill-bit, $U_s$ is compressive strength of material being drilled, A is amplitude of vibration, m is vibrating mass, and $S_f$ is a scaling factor greater than 1; and controlling dynamic force ($F_d$) of the oscillator in the resonance enhanced rotary drill whereby the dynamic force ($F_d$) is maintained in the range:

$$[(\pi/4)D^2_{eff}U_s] \leq F_d \leq S_{Fd}[(\pi/4)D^2_{eff}U_s]$$

where $D_{eff}$ is an effective diameter of the rotary drill-bit, $U_s$ is a compressive strength of material being drilled, and $S_{Fd}$ is a scaling factor greater than 1, wherein the frequency (f) and the dynamic force ($F_d$) of the oscillator are controlled by monitoring signals representing the compressive strength ($U_s$) of the material being drilled and adjusting the frequency (f) and the dynamic force ($F_d$) of the oscillator using a closed loop real-time feedback mechanism according to changes in the compressive strength ($U_s$) of the material being drilled.

* * * * *